US011211683B2

(12) United States Patent
Morgan

(10) Patent No.: US 11,211,683 B2
(45) Date of Patent: Dec. 28, 2021

(54) ANTENNA MOUNTING BRACKET ASSEMBLY

(71) Applicant: William Morgan, Aurora, CO (US)

(72) Inventor: William Morgan, Aurora, CO (US)

( * ) Notice: Subject to any disclaimer, the term of this patent is extended or adjusted under 35 U.S.C. 154(b) by 283 days.

(21) Appl. No.: 16/681,521

(22) Filed: Nov. 12, 2019

(65) Prior Publication Data

US 2021/0143522 A1 May 13, 2021

(51) Int. Cl.
*H01Q 1/32* (2006.01)
*H01Q 1/12* (2006.01)

(52) U.S. Cl.
CPC ..... *H01Q 1/1214* (2013.01); *H01Q 1/3283* (2013.01)

(58) Field of Classification Search
CPC ..... H01Q 1/12; H01Q 1/1214; H01Q 1/22; H01Q 1/32; H01Q 1/325; H01Q 1/3291; H01Q 1/3283
See application file for complete search history.

(56) References Cited

U.S. PATENT DOCUMENTS 3,967,275 A 6/1976 Wagman
4,028,705 A 6/1977 Loyd
4,107,694 A 8/1978 Morgan
4,114,160 A * 9/1978 Verini ..... H01Q 1/3258 248/539
4,161,735 A 7/1979 Zylla
4,249,182 A 2/1981 Rupley
5,008,682 A * 4/1991 Blaese ..... H01Q 1/088 343/713
D481,030 S 10/2003 Larson
2010/0220021 A1* 9/2010 Khreizat ..... H01Q 9/30 343/715
2012/0199720 A1 8/2012 Miller
2015/0194722 A1* 7/2015 Chinn ..... H01Q 1/1207 248/523

FOREIGN PATENT DOCUMENTS

EP 2144327 6/2016

* cited by examiner

*Primary Examiner* — Blane J Jackson

(57) ABSTRACT

An antenna mounting bracket assembly for coupling an antenna to a vehicle includes a first plate, a bar, and a coupler. A set of apertures positioned in the first plate is configured to be aligned with hinge holes positioned in an upper hinge. Hinge bolts are insertable through the apertures, the hinge holes, and holes positioned in a door frame of the vehicle so that the first plate is coupled to the vehicle. A spacer is coupled to and extends from a first face of the first plate. The bar is coupled to and extends from the spacer distal from the first plate so that the bar extends between the door frame and a door when the door is closed. The coupler is coupled to the bar distal from the spacer and is configured to couple to a mount of an antenna to couple the antenna to the vehicle.

19 Claims, 5 Drawing Sheets

ANTENNA MOUNTING BRACKET ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM.

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to mounting assemblies and more particularly pertains to a new mounting assembly for coupling an antenna to a vehicle.

(2) Description of Related Art Including Information Disclosed Under 37 CFR 1.97 and 1.98.

The prior art relates to mounting assemblies and more particularly to assemblies for mounting an antenna on a vehicle. Prior art assemblies for mounting an antenna on a vehicle may comprise threaded couplers to couple an antenna to a roof of a vehicle, clamps to couple an antenna to a mirror support arm or a trunk lid, assemblies mounted in and extendable from a trunk, and brackets that are bolted a door of a vehicle using mirror attachment holes.

BRIEF SUMMARY OF THE INVENTION

An embodiment of the disclosure meets the needs presented above by generally comprising a first plate, a bar, and a coupler. Each of a set of apertures that is positioned in the first plate is configured to be aligned with an associated hinge hole that is positioned in an upper hinge of a door of a vehicle. A respective hinge bolt is insertable through the aperture, the associated hinge hole, and an associated hole that is positioned in a door frame of the vehicle so that the first plate is coupled to the vehicle. A spacer is coupled to and extends from a first face of the first plate. The bar is coupled to and extends from the spacer distal from the first plate so that the bar extends between the door frame and an associated door when the associated door is closed. The coupler is coupled to the bar distal from the spacer and is configured to couple to a mount of an antenna to couple the antenna to the vehicle.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
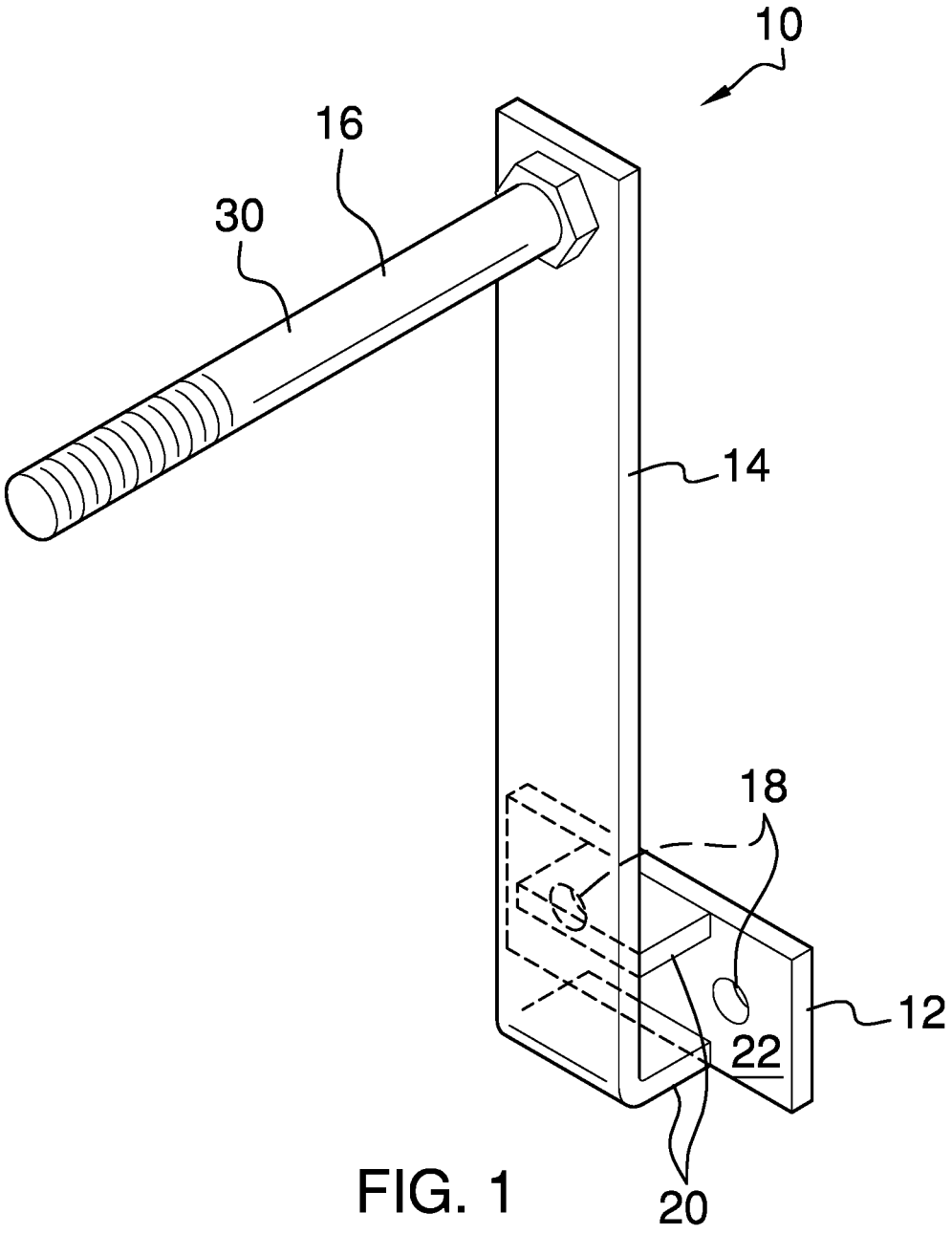
FIG. 1 is an isometric perspective view of an antenna mounting bracket assembly according to an embodiment of the disclosure.

With reference now to the drawings, and in particular to FIGS. 1 through 6 thereof, a new mounting assembly embodying the principles and concepts of an embodiment of the disclosure and generally designated by the reference numeral 10 will be described.

As best illustrated in FIGS. 1 through 6, the antenna mounting bracket assembly 10 generally comprises a first plate 12, a bar 14, and a coupler 16. The first plate 12 may be rectangularly shaped, or may be alternatively shaped, such as, but not limited to, ovally shaped, circularly shaped, and the like. Generally, the first plate 12 would be shaped complementarily to an end of an upper hinge of a door of a vehicle that is attached to a door frame of the vehicle.

Figure 2:
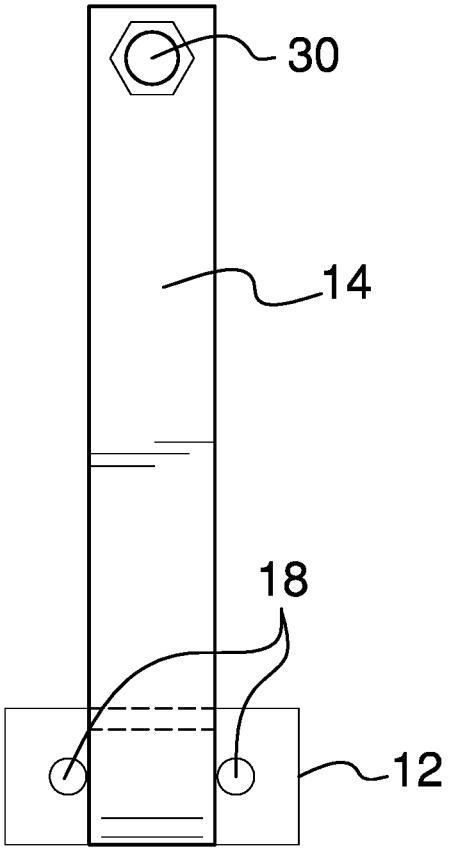
FIG. 2 is a front view of an embodiment of the disclosure.

Each of a set of apertures 18 that is positioned in the first plate 12 is configured to be aligned with an associated hinge hole that is positioned in the upper hinge of the door of the vehicle. A respective hinge bolt is insertable through the aperture 18, the associated hinge hole, and an associated hole that is positioned in the door frame of the vehicle so that the first plate 12 is coupled to the vehicle. The set of apertures 18 may comprise two apertures 18, as shown in FIG. 2, but also may comprise other numbers of apertures 18, such as three apertures 18 and four apertures 18, so that the apertures 18 are numbered equivalently to the hinge holes in the upper hinge.

A spacer 20 is coupled to and extends from a first face 22 of the first plate 12. The bar 14 is coupled to and extends from the spacer 20 distal from the first plate 12 so that the bar 14 extends between the door frame and an associated door when the associated door is closed. The spacer 20 may comprise a pair of second plates 24, or other spacing element, such as blocks, rods, bars, and the like. The second plates 24 are coupled singly to an upper edge 26 and a lower edge 28 of the first plate 12 and extend both perpendicularly to and codirectionally from the first plate 12.

Figure 3:
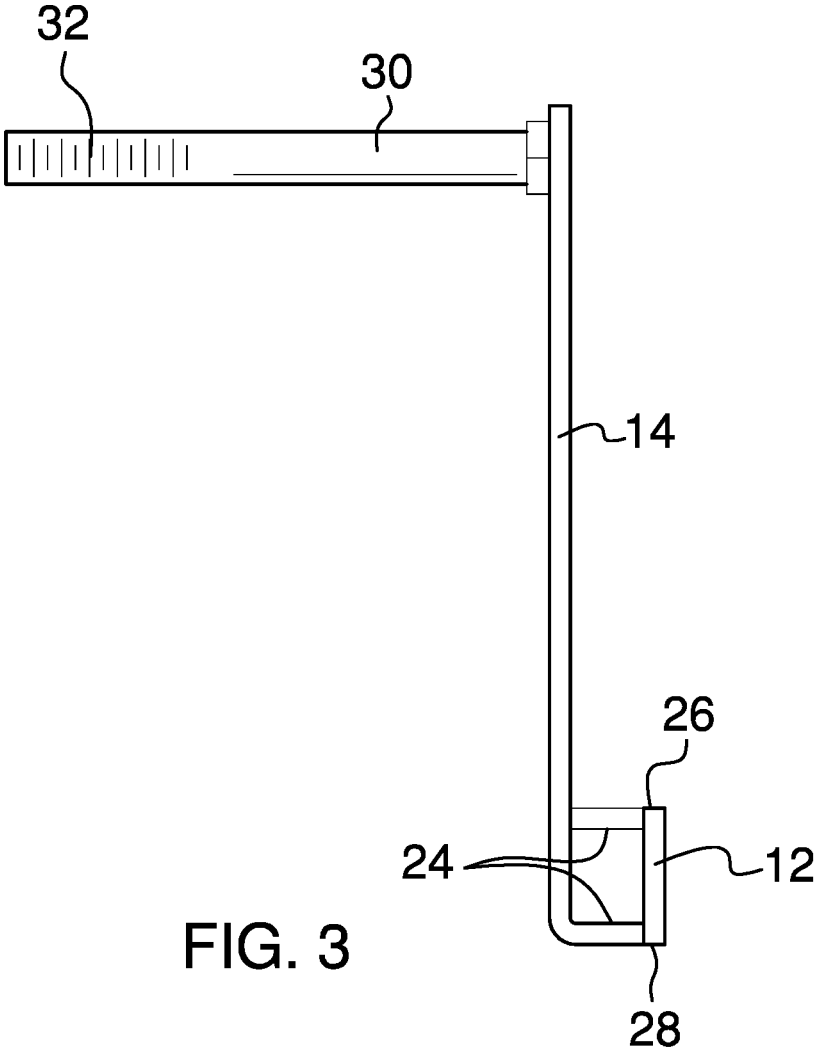
FIG. 3 is a side view of an embodiment of the disclosure.
Figure 4:
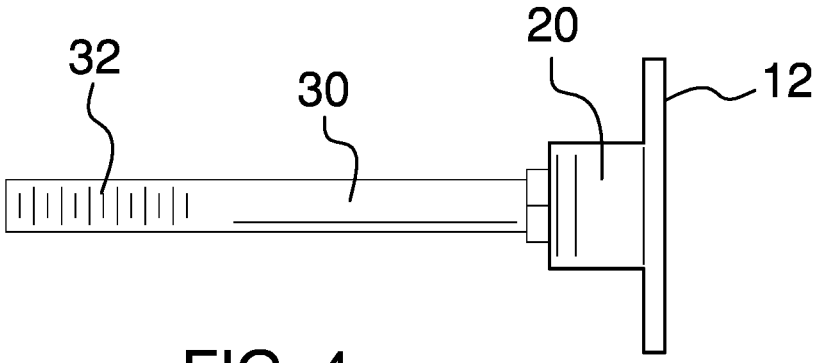
FIG. 4 is a bottom view of an embodiment of the disclosure.
Figure 5:
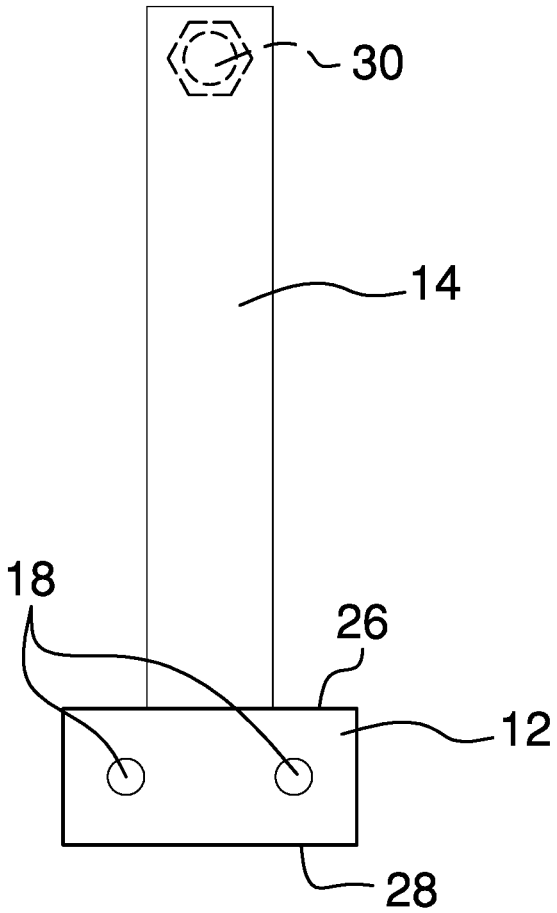
FIG. 5 is a back view of an embodiment of the disclosure.
Figure 6:
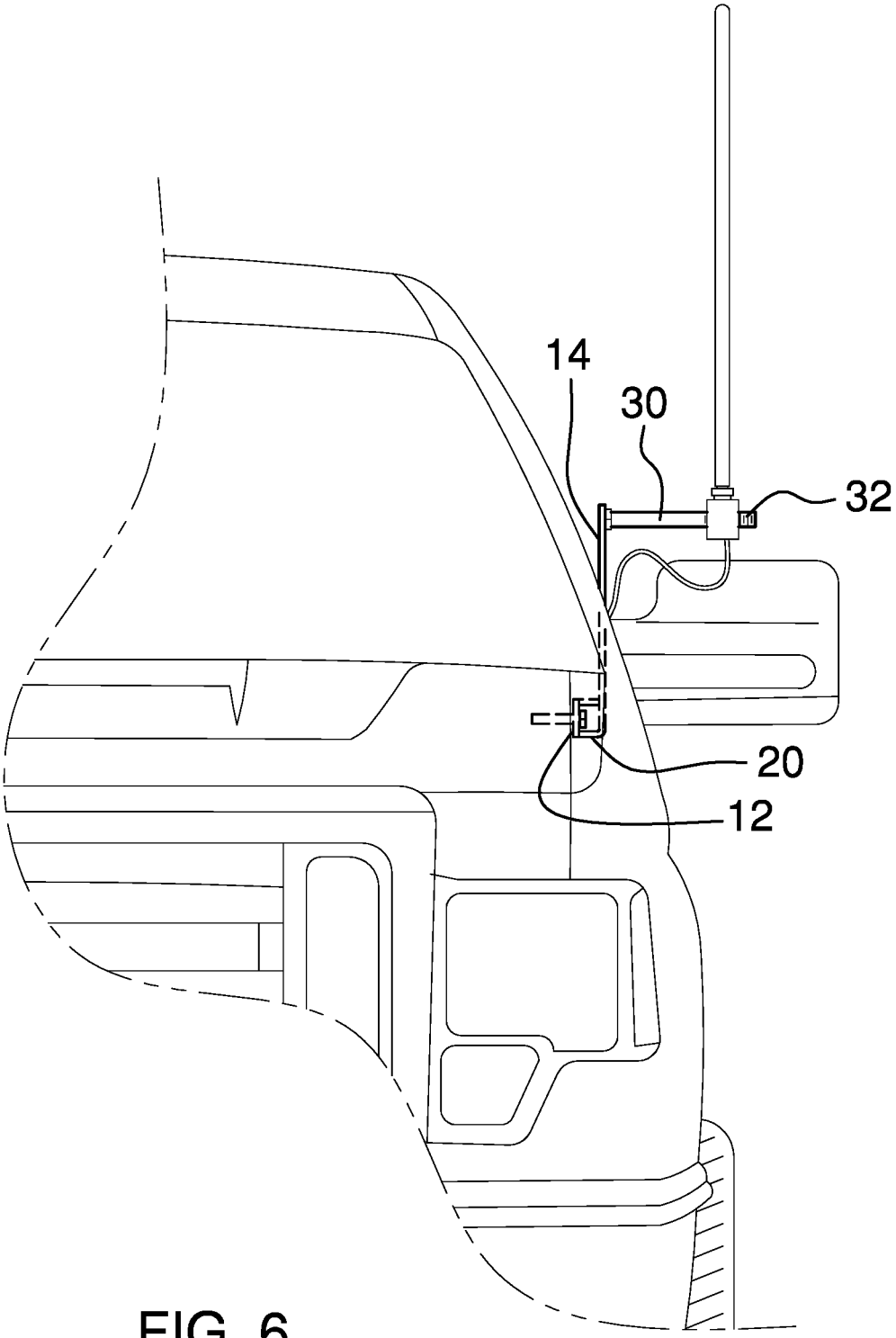
FIG. 6 is an in-use view of an embodiment of the disclosure.

The bar 14 may extend perpendicularly from the spacer 20, as shown in FIG. 3, so that the bar 14 is parallel to the first plate 12. Alternatively, the bar 14 may extend angularly from the spacer 20 (not shown) so that the bar 14 extends between the door frame and the door when the door is closed. The bar 14 may be rectangularly shaped. The bar 14 also may be planar, as shown in FIG. 3, or may be alternatively shaped, such as curvedly shaped, sinuously shaped, and the like, so that the bar 14 extends between the door frame and the door when the door is closed. The bar 14 measures from 15.0 to 36.0 centimeters in length. The bar 14 may measure approximately 25.4 centimeters in length.

The coupler 16 is coupled to the bar 14 distal from the spacer 20 and is configured to couple to a mount of an antenna to couple the antenna to the vehicle. The coupler 16 may comprise a rod 30 that is coupled to and extends from the bar 14 distal from the spacer 20. The rod 30 is threaded distal from the bar 14 and thus is configured to threadedly couple to the mount of the antenna to couple the antenna to the vehicle. The coupler 16 also may comprise other coupling means, such as, but not limited to, clamps, magnets, and the like.

The rod 30 measures from 1.0 to 2.0 centimeters in diameter. The rod 30 may measure approximately 1.6 centimeters in diameter. The rod 30 measures from 10.0 to 20.0 centimeters in length. The rod 30 may measure approximately 15.9 centimeters in length. A threaded section 32 of the rod 30 measures from 2.5 to 5.0 centimeters in length. The threaded section 32 of the rod 30 may measure 3.8 centimeters in length. The rod 30 may extend perpendicularly from the bar 14, as shown in FIG. 3, or may extend angularly from the bar 14 (not shown) depending on how the bar 14 is shaped. Generally, the rod 30 would extend from the bar 14 so that the rod 30 is substantially parallel to a level surface upon which the vehicle is positioned.

In use, the hinge bolts are removed from the hinge holes in the upper hinge and the associated holes in the door frame. The set of apertures 18 is aligned with the hinge holes in the upper hinge and then the hinge bolts are reinserted through the set of apertures 18, the hinge holes, and the associated holes in the door frame of the vehicle so that the assembly 10 is coupled to the vehicle. The mount of the antenna then is threadedly coupled to the rod 30 to couple the antenna to the vehicle.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be only one of the elements.

I claim:

1. An antenna mounting bracket assembly comprising:

a first plate;

a set of apertures positioned in the first plate wherein each aperture is configured for aligning with an associated hinge hole positioned in an upper hinge such that a respective hinge bolt is insertable through the aperture, the associated hinge hole, and an associated hole positioned in a door frame of a vehicle such that the first plate is coupled to the vehicle;

a spacer coupled to and extending from a first face of the first plate;

a bar coupled to and extending from the spacer distal from the first plate such that the bar extends between the door frame and an associated door when the associated door is closed; and a coupler coupled to the bar distal from the spacer, the coupler being configured for coupling to a mount of an antenna wherein the coupler is configured for coupling the antenna to the vehicle.

2. The assembly of claim 1, further including the first plate being rectangularly shaped.

3. The assembly of claim 1, further including the set of apertures comprising two apertures.

4. The assembly of claim 3, further including the apertures bracketing the spacer such that the apertures are accessible for insertion of the hinge bolts.

5. The assembly of claim 1, further including the spacer comprising a pair of second plates, the second plates being coupled singly to an upper edge and a lower edge of the first plate and extending perpendicularly to and codirectionally from the first plate.

6. The assembly of claim 1, further including the bar extending perpendicularly from the spacer such that the bar is parallel to the first plate.

7. The assembly of claim 1, further including the bar being rectangularly shaped.

8. The assembly of claim 1, further including the bar being planar.

9. The assembly of claim 1, further including the bar measuring from 15.0 to 36.0 centimeters in length.

10. The assembly of claim 9, further including the bar measuring approximately 25.4 centimeters in length.

11. The assembly of claim 1, further including the coupler comprising a rod, the rod being coupled to and extending from the bar distal from the spacer, the rod being threaded distal from the bar wherein the rod is configured for threadedly coupling to the mount of the antenna for coupling the antenna to the vehicle.

12. The assembly of claim 11, further including the rod measuring from 1.0 to 2.0 centimeters in diameter.

13. The assembly of claim 12, further including the rod measuring approximately 1.6 centimeters in diameter.

14. The assembly of claim 11, further including the rod extending perpendicularly from the bar.

15. The assembly of claim 11, further including the rod measuring from 10.0 to 20.0 centimeters in length.

16. The assembly of claim 15, further including the rod measuring approximately 15.9 centimeters in length.

17. The assembly of claim 11, further including a threaded section of the rod measuring from 2.5 to 5.0 centimeters in length.

18. The assembly of claim 17, further including the threaded section of the rod measuring 3.8 centimeters in length.

19. An antenna mounting bracket assembly comprising:

a first plate, the first plate being rectangularly shaped;

a set of apertures positioned in the first plate wherein each aperture is configured for aligning with an associated hinge hole positioned in an upper hinge such that a respective hinge bolt is insertable through the aperture, the associated hinge hole, and an associated hole positioned in a door frame of a vehicle such that the first plate is coupled to the vehicle, the set of apertures comprising two apertures;

a spacer coupled to and extending from a first face of the first plate, the apertures bracketing the spacer such that the apertures are accessible for insertion of the hinge bolts, the spacer comprising a pair of second plates, the second plates being coupled singly to an upper edge and a lower edge of the first plate and extending perpendicularly to and codirectionally from the first plate;

a bar coupled to and extending from the spacer distal from the first plate such that the bar extends between the door frame and an associated door when the associated door is closed, the bar extending perpendicularly from the spacer such that the bar is parallel to the first plate, the bar being rectangularly shaped, the bar being planar, the bar measuring from 15.0 to 36.0 centimeters in length, the bar measuring approximately 25.4 centimeters in length; and a coupler coupled to the bar distal from the spacer, the coupler being configured for coupling to a mount of an antenna wherein the coupler is configured for coupling the antenna to the vehicle, the coupler comprising a rod, the rod being coupled to and extending from the bar distal from the spacer, the rod being threaded distal from the bar wherein the rod is configured for threadedly coupling to the mount of the antenna for coupling the antenna to the vehicle, the rod measuring from 1.0 to 2.0 centimeters in diameter, the rod measuring approximately 1.6 centimeters in diameter, the rod extending perpendicularly from the bar, the rod measuring from 10.0 to 20.0 centimeters in length, the rod measuring approximately 15.9 centimeters in length, a threaded section of the rod measuring from 2.5 to 5.0 centimeters in length, the threaded section of the rod measuring 3.8 centimeters in length.

* * * * *